US010484795B2

(12) United States Patent
Li et al.

(10) Patent No.: US 10,484,795 B2
(45) Date of Patent: Nov. 19, 2019

(54) SPEAKER TERMINALS

(71) Applicant: Harman International Industries, Incorporated, Stamford, CT (US)

(72) Inventors: Frank Li, Suzhou (CN); Sum Zhang, Suzhou (CN); Bo Sun, Suzhou (CN)

(73) Assignee: Harman International Industries, Incorporated, Stamford, CT (US)

( * ) Notice: Subject to any disclaimer, the term of this patent is extended or adjusted under 35 U.S.C. 154(b) by 18 days.

(21) Appl. No.: 15/715,347

(22) Filed: Sep. 26, 2017

(65) Prior Publication Data

US 2019/0098414 A1 Mar. 28, 2019

(51) Int. Cl.

| | |
|---|---|
| ***H04R 9/02*** | (2006.01) |
| ***H04R 9/06*** | (2006.01) |
| ***H04R 1/06*** | (2006.01) |
| ***H04R 9/04*** | (2006.01) |
| *H04R 31/00* | (2006.01) |

(52) U.S. Cl.

CPC ..... *H04R 9/02* (2013.01); *H04R 1/06* (2013.01); *H04R 9/043* (2013.01); *H04R 9/06* (2013.01); *H04R 31/006* (2013.01)

(58) Field of Classification Search

CPC . H04R 1/06; H04R 9/06; H04R 9/043; H04R 9/045; H04R 9/02; H04R 31/006

See application file for complete search history.

(56) References Cited

U.S. PATENT DOCUMENTS

| | | | | |
|---|---|---|---|---|
| 5,757,945 | A * | 5/1998 | Sakamoto | H04R 9/06 381/400 |
| 6,633,649 | B1 | 10/2003 | Honnert et al. | |
| 2008/0080736 | A1 * | 4/2008 | Sumitani | H04R 9/043 381/407 |
| 2016/0227325 | A1 | 8/2016 | Pare et al. | |

FOREIGN PATENT DOCUMENTS

| | | |
|---|---|---|
| EP | 0720415 A2 | 7/1996 |

* cited by examiner

*Primary Examiner* — Joshua Kaufman
(74) *Attorney, Agent, or Firm* — Angela M. Brunetti

(57) ABSTRACT

A configuration of speaker terminals in a speaker basket. The configuration of speaker terminals has a set of conductive terminals positioned adjacent to one another on a single side of the speaker basket. The set of conductive terminals are coupled between a spider retained in the speaker basket and a connector element, also positioned on the single side of speaker basket.

5 Claims, 3 Drawing Sheets

SPEAKER TERMINALS

TECHNICAL FIELD

The inventive subject matter is directed to a speaker assembly, and more particularly to speaker terminals for a speaker assembly.

BACKGROUND

Speakers convert electrical energy into sound. When electrical energy flows into a voice coil, an induced magnetic field may be created that interacts with magnetic flux in an air gap. The interaction between the voice coil and the magnetic flux moves a diaphragm in order to produce audible sound. This is facilitated by speaker terminals that provide the connection between the voice coil and an audio source. A foremost concern in a loudspeaker is, of course, sound quality. Other concerns in speaker applications may include weight, balance, vibration and many other elements that are known to disrupt speaker performance. Such concerns factor into the design of a complete loudspeaker assembly and includes the speaker terminals.

The design and implementation of speaker terminals in the speaker assembly have a direct impact on the speaker performance. Therefore, the reliability of speaker terminals is a main concern for optimal speaker performance.

SUMMARY

A configuration of speaker terminals in a speaker basket. The configuration of speaker terminals has a set of conductive terminals positioned adjacent to one another on a single side of the speaker basket. The set of conductive terminals are coupled between a spider retained in the speaker basket and a connector element, also positioned on the single side of speaker basket.

Elements and steps in the figures are illustrated for simplicity and clarity and have not necessarily been rendered according to any particular sequence. For example, steps that may be performed concurrently or in different order are illustrated in the figures to help to improve understanding of embodiments of the inventive subject matter.

DETAILED DESCRIPTION

While various aspects of the inventive subject matter are described with reference to illustrative embodiments, the inventive subject matter is not limited to such embodiments, and additional modifications, applications, and embodiments may be implemented without departing from the inventive subject matter. In the figures, like reference numbers will be used to illustrate the same components. Those skilled in the art will recognize that the various components set forth herein may be altered without varying from the scope of the inventive subject matter.

Figure 1:
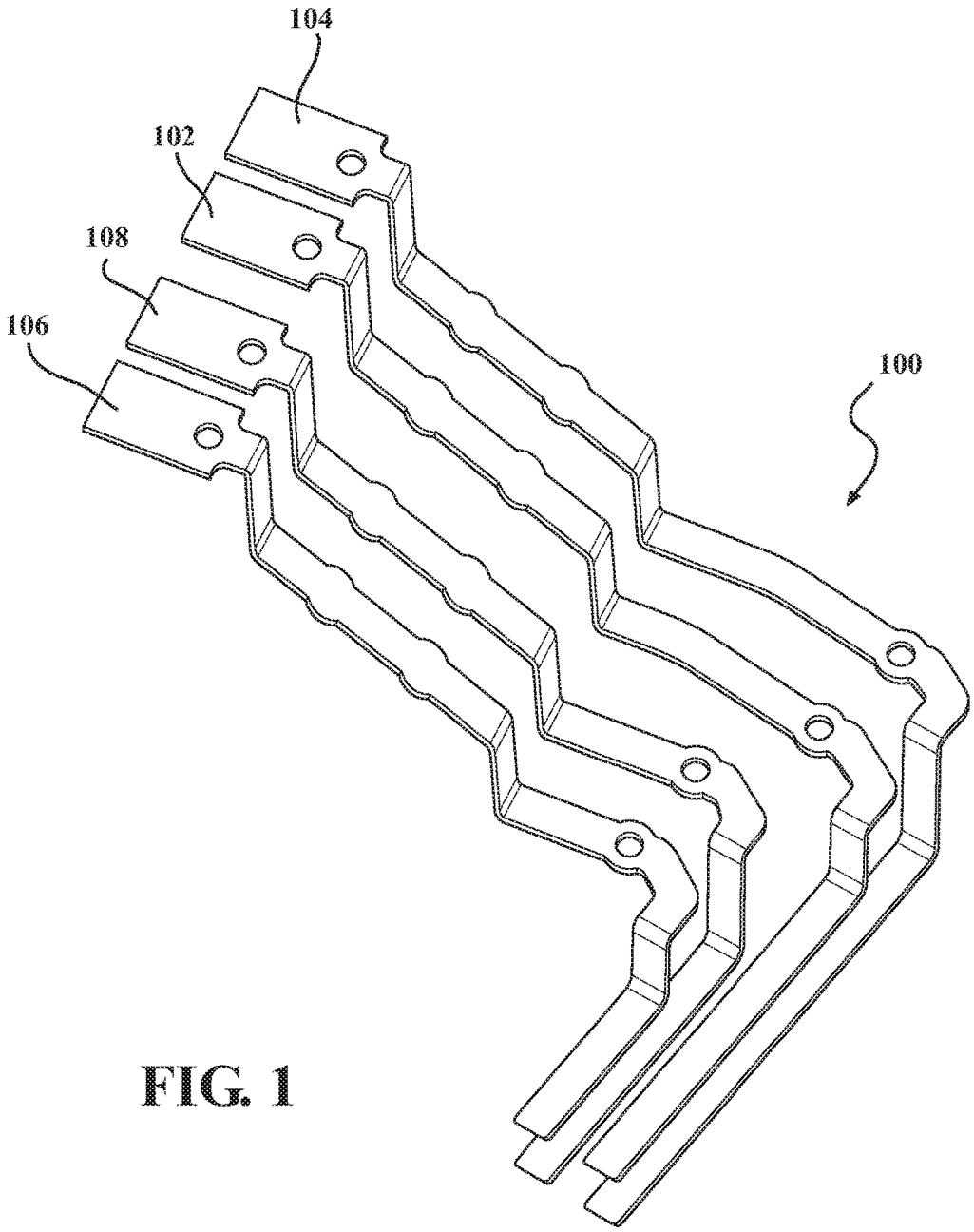
FIG. 1 is a perspective view of a configuration of speaker terminals of one or more embodiments.

FIG. 1 is a perspective view of a configuration of speaker terminals 100. The example shown in FIG. 1 is a configuration of speaker terminals 100 for handling two input signals. The configuration of speaker terminals has a first positive conductive input terminal 102 and a first negative conductive input terminal 104 to create a first electromagnetic field. The configuration of speaker terminals 100 has a second positive conductive input terminal 106 and a second negative conductive input terminal 108 to create a second electromagnetic field. The configuration 100 of the terminals 102, 104, 106, 108 is such that the terminals are each adjacent to one another. Each of the terminals 102, 104, 106, 108 has first and second ends that are incorporated into a speaker basket, not shown, and configured to be conductively coupled between a connector to an audio source and a spider in the speaker basket. The speaker terminals 102, 104, 106, 108 are positioned adjacent with one another so that coupling occurs on one common side of the speaker basket and are arranged to receive an audio input signal from the audio source.

Figure 2:
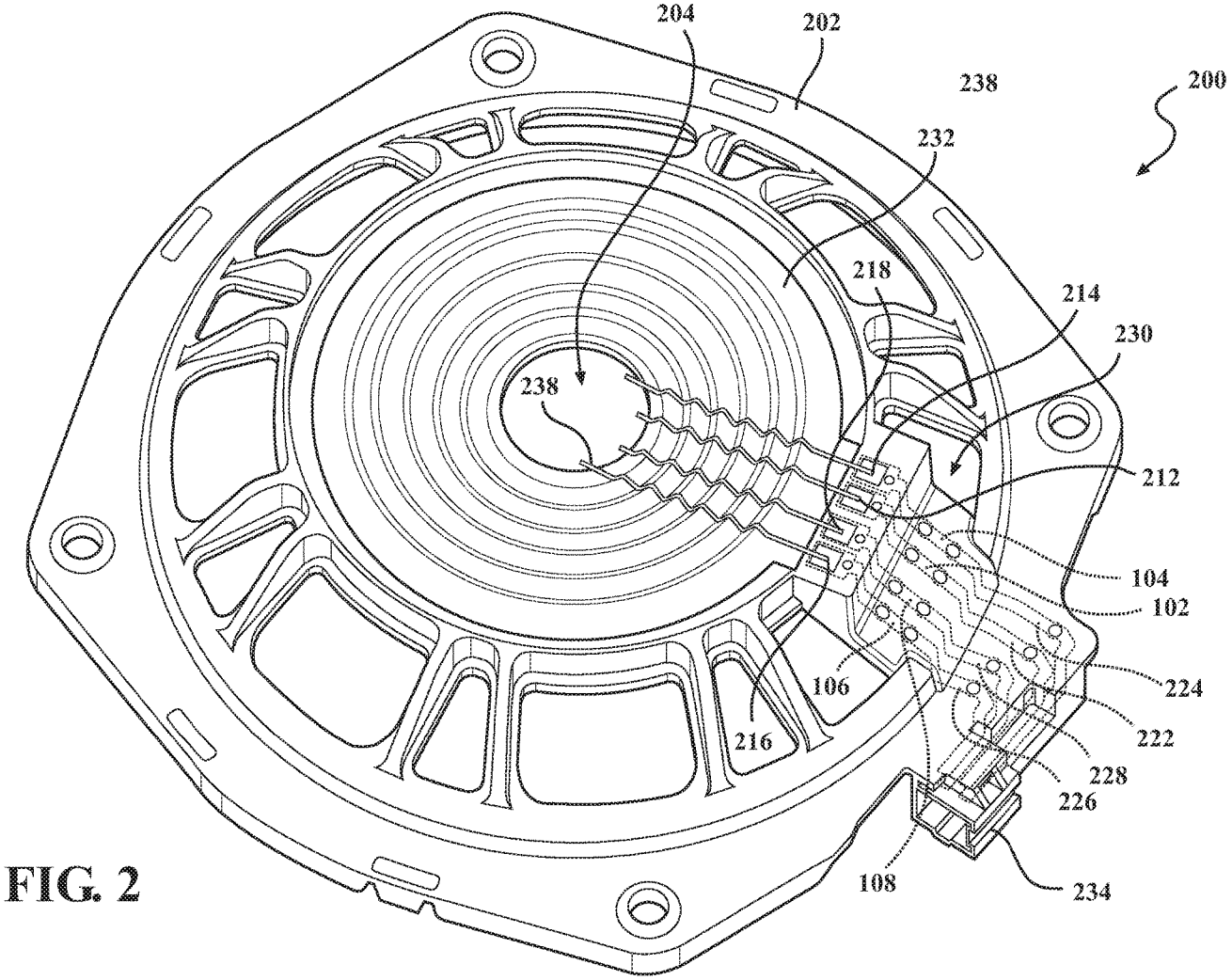
FIG. 2 is a perspective view of a speaker basket that incorporates the configuration speaker terminals of FIG. 1.

FIG. 2 is a bottom-view perspective of a speaker basket assembly 200 that incorporates the speaker terminal configuration of FIG. 1. The four terminals 102, 104, 106, 106, 108 are arranged adjacent to one another on one common side 230 of a speaker basket 202 in the speaker basket assembly 200. A first end 212, 214, 216, 218 of each of the terminals 102, 104, 106, 108 are to be conductively coupled to a spider 232 that retains a voice coil (not shown). A second end 222, 224, 226, 228 of each of the terminals 102, 104, 106, 108 is conductively coupled to a connector 234, which may be molded into the speaker basket 202 as shown in FIG. 2. The connector 234 couples the speaker assembly 200 to an audio source (not shown). The spider 232 is positioned in a center opening 204 of the speaker basket 202. A voice coil (now shown in FIG. 2) is retained in the center opening 204. The speaker terminals 102, 104, 106, 108 may be conductively coupled to the spider 232 using a plurality of tinsel wires, such as Litz wire 238. For example, the Litz wires 238 are woven in the spider and terminate at an end in the center opening 204.

The speaker terminals 102, 104, 106, 108 adjacent to each other and positioned on the same side 230 of the speaker basket reduce the complexity of a geometry of the terminal as well as the overall length of the terminal. Several advantages are presented by this configuration. The terminals 102, 104, 106, 108 are easier to manufacture because their geometry is much simpler than known terminals that are typically placed on two sides of the speaker basket and must follow an outer diameter curve of the speaker basket. Also, known terminals placed on two sides of the speaker basket require multiple connectors and/or a wire harness assembly in order to connect to the audio source. The terminals 102, 104, 106, 108 positioned adjacent to each other on a same, single side of the speaker basket assembly provide a more direct, shorter path from the spider to connector 234. Each of these results in a more reliable speaker assembly as well as a reduced manufacturing cost. Further, because of the shorter, more direct terminals and fewer connectors that do not require a wire harness assembly that is typically used in known speaker basket assemblies, a weight savings may also be realized.

Figure 3:
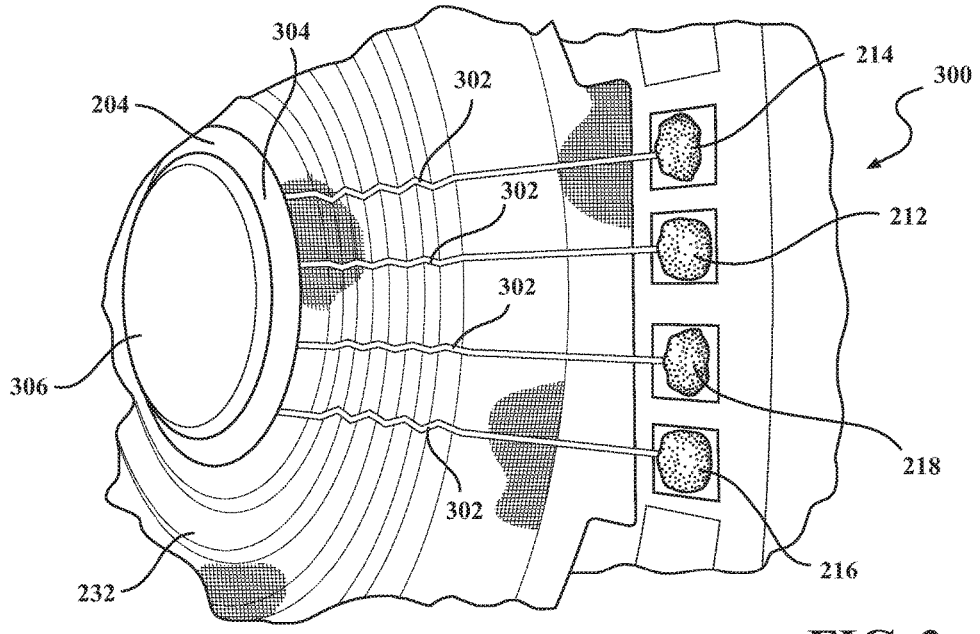
FIG. 3 is a close-up view of a spider electrically coupled to the configuration of speaker terminals of FIG. 1.

FIG. 3 is a close-up view 300 of the spider 232 and the first conductive ends 212, 214, 216, 218 of the speaker terminals for the two input configuration of speaker terminals disclosed in FIGS. 1 and 2. Four Litz wires 302 are soldered at the first conductive ends 212, 214, 216, 218, stitched along, or woven into, the spider 232 and terminate at a voice coil 304 near the center opening 204 of the speaker basket at a voice coil (304) having a dust cap 306 to protect the voice coil 304. The configuration of speaker terminals maintains a balanced vibration and does not adversely affect the total harmonic distortion of a loudspeaker assembly. An inverse ratio relationship exists between displacement and stiffness of the spider 232. Displacement of the spider 232 is typically smaller than 0.5 mm/50 g. A maximum weight should be smaller than 0.04 times a total weight of a mechanical mass of a diaphragm assembly including air load and the voice coil. Therefore, four tinsel wires weighing in at 0.2 g each is 0.8 g would require the total weight of the mechanical mass of a diaphragm assembly including air load and voice coil to be 20 g. Further, a mechanical compliance of driver suspension should be maintained smaller than 1 mm/N. Taking such considerations into account, the speaker basket assembly having four adjacent terminals and tinsel wires positioned on the same side of the spider does not adversely affect the total harmonic distortion.

Figure 4:
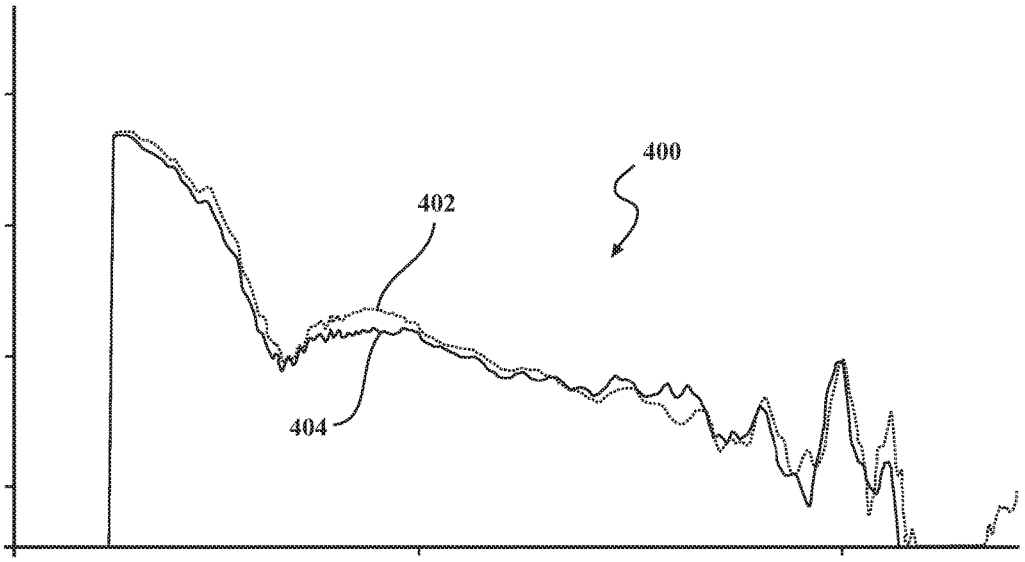
FIG. 4 is a graph comparing acoustic performance for speaker assemblies having the terminal configuration of FIGS. 1-3 with acoustic performance of a two-sided speaker terminal configuration as known in the art.

FIG. 4 is a graph 400 comparing total harmonic distortion for speaker assemblies having a one-sided configuration of speaker terminals as described herein with reference to FIGS. 1-3 with a two-sided speaker terminal configuration that is typically known. The two-sided speaker terminal configuration has a complex terminal configuration to run the terminals around the center opening of the speaker basket so that there is a pair of terminals at two opposite sides of the speaker center opening. In the alternative, known speaker basket assemblies may use a wire harness to connect the pairs of terminals at two sides of the speaker basket. The graph shows amplitude v. frequency of a first graph 402 for a two-sided speaker terminal configuration known in the art. A second graph 404 shows amplitude v. frequency for the one-sided configuration of speaker terminals described herein with reference to FIGS. 1-3. The graph comparison shows that total harmonic distortion is not significantly affected by the terminal configuration described with reference to FIG. 1 wherein four terminals are positioned adjacent to one another on the same side of the speaker basket.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution, to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, configurations, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

The invention claimed is:

1. A speaker basket for a loudspeaker assembly having a driver diaphragm assembly that includes a set of tinsel wires and a voice coil, a total weight of the loudspeaker assembly includes air load, the speaker basket comprising:

a basket having a center opening therein and a connector element integrated into the basket on a single side of the basket; and a set of conductive terminals molded into the connector element, the set of conductive terminals are coupled between the center opening and the connector element, each of the conductive terminals in the set of conductive terminals are adjacent to each other within the connector and positioned on the single side of the basket, a ratio of 0.04 or less is maintained for a maximum weight of the set of tinsel wires divided by the total weight of the loudspeaker assembly.

2. The speaker basket as claimed in claim 1 wherein each set of conductive terminals further comprises:

a first positive conductive terminal and a first negative conductive terminal; and at least a second positive conductive terminal and at least a second negative conductive terminal.

3. The speaker basket as claimed in claim 1 further comprising;

a spider retained in the center opening of the speaker basket for receiving a voice coil;

wherein each wire of the set of tinsel wires is woven into the spider and each wire is conductively coupled at a first end of each of the conductive terminals in the set of conductive terminals molded into the connector element and terminating at the voice coil; and a second end of each of the conductive terminals molded into the connector element.

4. The speaker basket as claimed in claim 3 wherein each wire in the plurality of wires is a Litz wire.

5. A configuration of terminals in a speaker basket of a loudspeaker assembly, the speaker basket having a center opening that is conductively coupled to a spider having a set of tinsel wires, the center opening for receiving a voice coil and a connector on a single side of the speaker basket, the loudspeaker assembly has a total weight that includes air load, the configuration of terminals comprising:

a plurality of positive conductive terminals and a plurality of negative conductive terminals, each positive conductive terminal being positioned adjacent to a negative conductive terminal such that the plurality of positive conductive terminals and the plurality of negative conductive terminals are all positioned on the single side of the speaker basket having the connector;

a first conductive end of each positive and negative conductive terminal coupled to the center opening; and a second conductive end of each positive and negative conductive terminal coupled to the connector;

wherein the plurality of positive and negative conductive terminals is molded into the connector;

wherein the connector is integrated into the speaker basket; and a ratio of 0.04 or less is maintained for a maximum weight of the set of tinsel wires divided by the total weight of the loudspeaker assembly.

* * * * *